United States Patent [19]

Stein et al.

[11] 3,934,365

[45] Jan. 27, 1976

[54] SIGN FRAME

[75] Inventors: Clinton L. Stein; Dennis D. Holien, both of Watertown, S. Dak.

[73] Assignee: Esco, Inc., Watertown, S. Dak.

[22] Filed: June 17, 1974

[21] Appl. No.: 479,813

Related U.S. Application Data

[63] Continuation-in-part of Ser. No. 334,631, Feb. 22, 1973, abandoned.

[52] U.S. Cl. ..... 40/125 G; 38/102.5; 40/125 H; 160/378

[51] Int. Cl.[2] ..... G09F 7/00

[58] Field of Search ..... 40/125 G, 125 K, 125 F, 40/125 R, 125 H, 125 N; 38/102.5, 102.91; 160/328, 378

[56] References Cited

UNITED STATES PATENTS

| | | | |
|---|---|---|---|
| 1,270,287 | 6/1918 | Greenwell | 160/328 |
| 1,535,408 | 4/1925 | Fricke | 40/125.G |
| 2,072,754 | 3/1937 | Jones | 40/125 G |
| 2,507,857 | 5/1950 | Johnson | 40/125 K |
| 2,553,125 | 5/1951 | Atkinson | 160/328 |
| 3,359,663 | 12/1967 | Black | 38/102.91 |
| 3,482,343 | 12/1969 | Hamu | 38/102.5 |
| 3,678,607 | 7/1972 | Tabor et al. | 38/102.91 |
| 3,726,055 | 4/1973 | Bower et al. | 40/125 G |
| 3,758,972 | 9/1973 | Egermayer | 40/125 K |

*Primary Examiner*—Louis G. Mancene
*Assistant Examiner*—John F. Pitrelli
*Attorney, Agent, or Firm*—Dorsey, Marquart, Windhorst, West & Halladay

[57] ABSTRACT

A sign of the type generally intended for internal illumination having a sign frame, a flexible material covering at least one face of said sign frame, and means for supporting the flexible material over the face of the sign frame and for stretching and tensioning such flexible material.

14 Claims, 13 Drawing Figures

Fig. 1
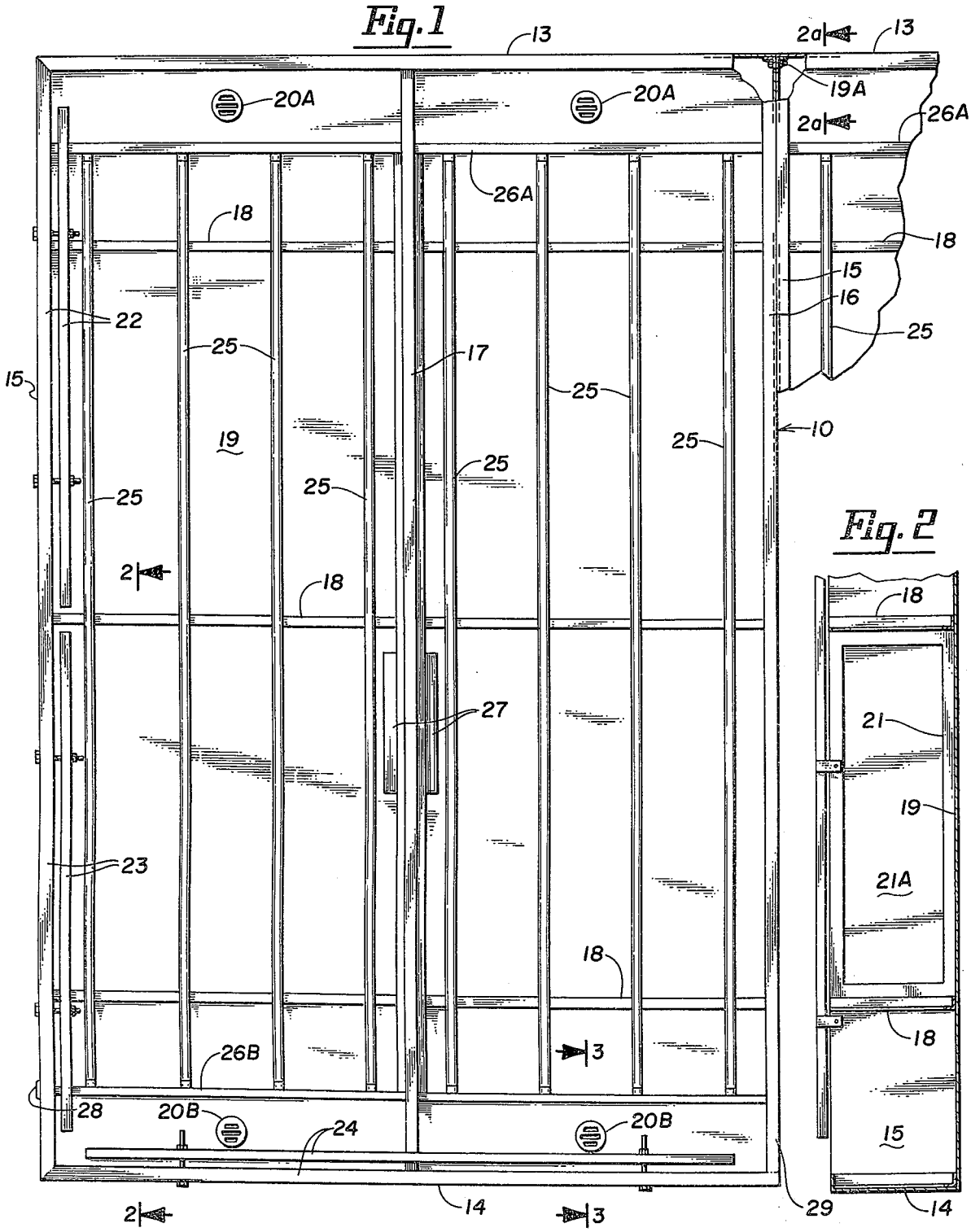
Fig. 2
Fig. 1a
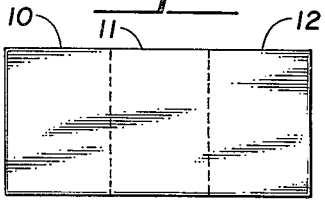
Fig. 2a
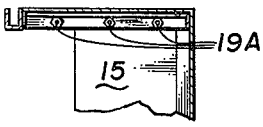
Fig. 3
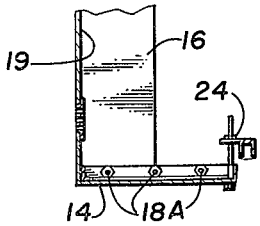

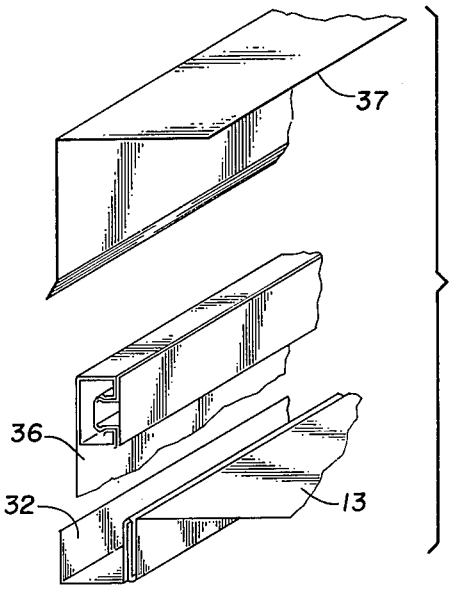
Fig. 5
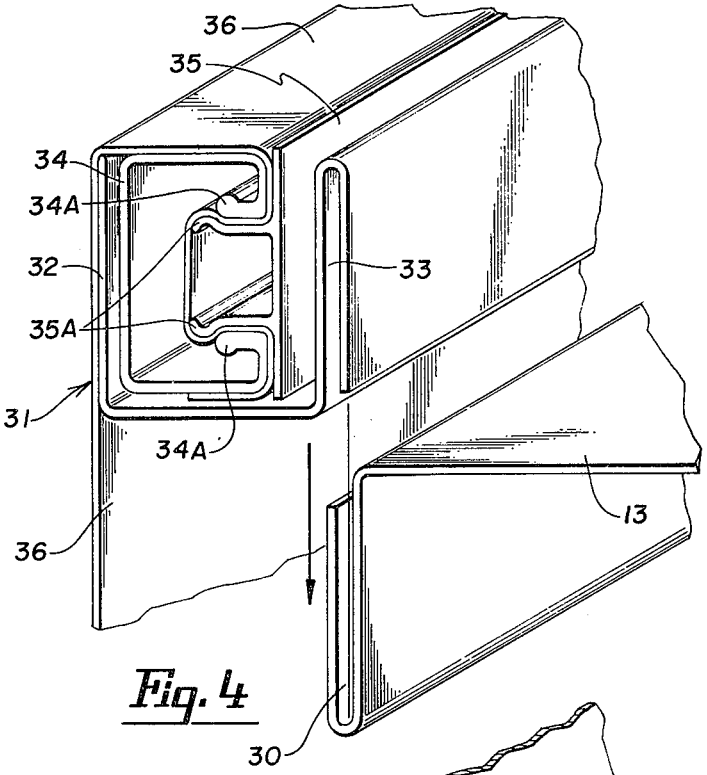
Fig. 4
Fig. 7
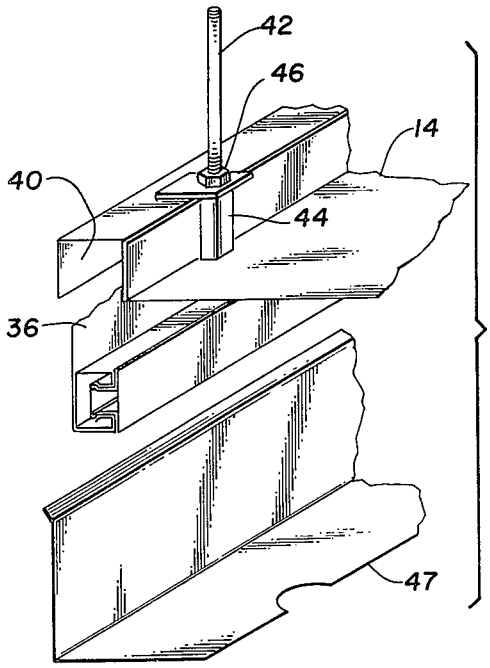
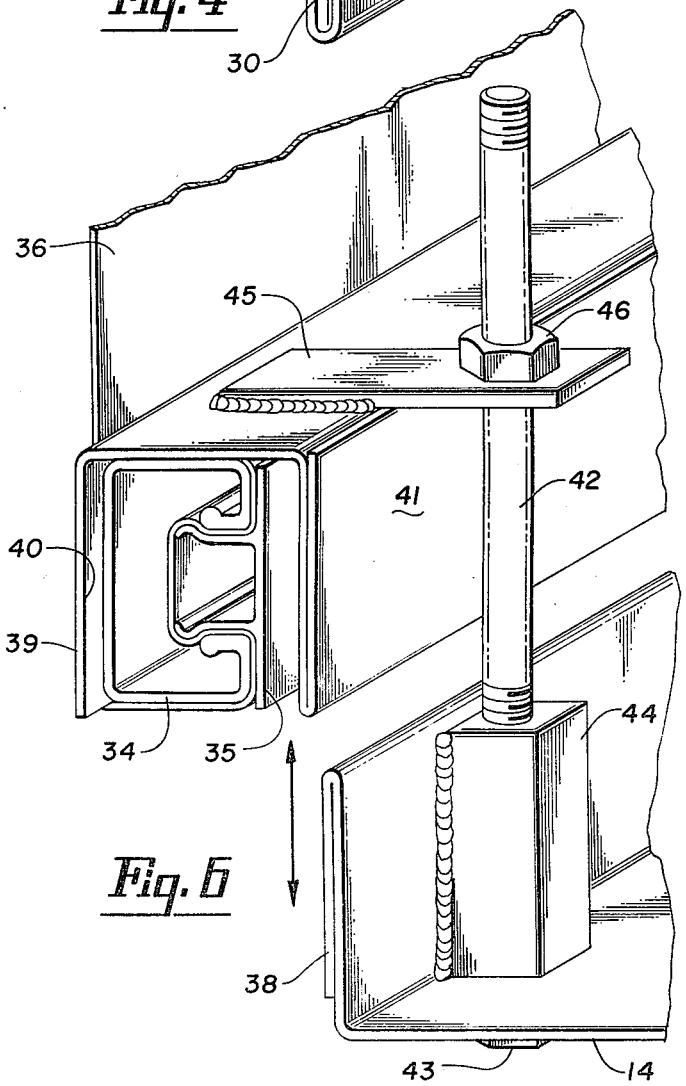
Fig. 6 hand bounding member 16 is adapted for connection with an adjacent left hand member 15 of an adjacent module. In addition to the bounding members, each of the individual module frames is further made rigid with a vertically extending center member 17 and three laterally disposed cross members 18. In the preferred embodiment, the supporting member 17 is a roll formed 18 gauge supporting member and supporting members 18 comprise pieces of conventional angle iron. Connected with the rear surface of the sign frame is a covering 19 which encloses the entire back side of the frame. Such covering 19 is provided with ventilating openings 20A at the top and 20B at the bottom for ventilation and circulation of air. Further, access openings 21 for servicing are provided in the end of certain bounding members such as member 15 illustrated in FIG. 2. When servicing of the frame is not being conducted, such openings 21 are enclosed by a detachable cover 21A (FIG. 2). As will be discussed in more detail below, the face material stretching and tightening means are illustrated generally in FIG. 1 by reference numerals 22, 23 and 24. Illumination for passing light through the translucent face material which is stretched over the sign frame is provided by fluorescent lamps 25 connected through wiring raceways 26A and 26B to ballasts 27. External connection from a power source (not shown) is made at the outlet 28 and interconnecting means between modules are provided by a suitable connector 29. In the preferred construction of each of the modules, the bounding members 13, 14, 15 and 16 are constructed from 18 gauge steel with angle irons welded to the edges for reinforcement.

As illustrated in FIGS. 1, 2A and 3 adjacent modules are connected together by bolting the tops and bottoms of the modules together. Specifically, as illustrated in FIGS. 2A, three bolts 19A are used to connect the top ends of the bounding member 15 of one module with the bounding member 16 of an adjacent module. Similarly, as illustrated in FIG. 3, three bolts 18A are used to connect the bottom ends of adjacent modules together.

Reference is next made to FIGS. 4 and 5 which illustrate the means by which the translucent face material 36 is gripped and fixedly secured along the upper edge of the sign frame. Specifically, with reference to FIG. 4, the upper bounding member 13 terminates with a lip portion to form a vertically extending groove 30. When the sign frame is constructed, this groove 30 is disposed on the front side of the sign frame. The vertical groove 30 is adapted to receive the tongue portion of a second vertical groove 33 formed along one edge of a generally U-shaped channel member 31 such that engagement between the groove 33 and 30 and their corresponding tongue portions cause connection between the channel member 31 and the bounding member 13. Such connection is illustrated best in FIG. 5. Adapted for insertion into the upwardly facing U-shaped channel member 31 is a means for gripping the upper edge of the translucent face material 36. Specifically, this gripping means includes a pair of clamping or gripping members 34 and 35. As illustrated, clamping member 35 includes a pair of outwardly protruding members 35A adapted for clamping arrangement with corresponding members 34A of the clamping member 34. The translucent face material is gripped by the members 34 and 35 by joining the members 34 and 35 as shown with the upper edge of the facing material 36 disposed therebetween. The gripping means is then disposed in the channel portion 32 of the channel member 31 and the face material 36 is allowed to hang over the front surface thereof.

During the stretching process which will be discussed in detail later in the specification, the face material 36 is pulled and stretched downwardly. Such stretching has a tendency to rotate the gripping elements 34 and 35 in a counterclockwise direction; however, such rotation is intended to be limited by the internal dimensions of the channel 32. Thus, although the particular channel size is not critical, the internal dimensions of such channel must be smaller than the diagonal dimension of the elements 34 and 35 in their connected position. Such maximum dimension is necessary to limit the counterclockwise rotation of the elements 34 and 35 when the face material is stretched. Of course, the internal dimension of the U-shaped member 32 must also be sufficiently large to accommodate the gripping means 34 and 35.

As illustrated in FIG. 5, after the face gripping means has been inserted into the channel 32, an ornamental cover 37 is added. In the preferred embodiment, the member 37 is an angle member which is connected with the bounding member 13 by a plurality of sheet metal screws (not shown).

Reference is next made to FIGS. 6 and 7 which show the means for gripping the lower edge of the translucent face material 36 and for stretching such face material 36 in a vertical direction. Specifically, as illustrated in FIG. 6, the bounding member 14 terminates in a lapped facing 38. Associated with the bounding member 14 and the facing 38 is a channel member 39 having a downwardly opened U-shaped channel 40. One end of the member 39 terminates in a lapped facing 41. As illustrated, the member 39 is connected with the bounding member 14 by a threaded rod 42. The rod 42 is fixed to the bounding member 14 through a block 44 welded to the member 14 and is threadedly secured with respect to the channel member 39 by the hex nut 46 and the bracket member 45 welded to the top of the member 39. The rod 42 is not threadedly associated with the block 44, but rather, passes through a hole in the block 44 and terminates in a head 43. As can be seen, when the rod 42 is rotated the vertical position of the channel member 39 with respect to the bounding member 14 is adjusted as indicated by the arrow in FIG. 6.

Associated with the channel member 39 is a means for gripping the lower edge of the translucent face material 36. Such gripping means includes a pair of gripping elements 34 and 35 which are identical to the elements 34 and 35 illustrated in FIGS. 4 abd 5 and grip the facing material 36 in the same manner. As shown in FIGS. 6 and 7, the lower edge of the face material 36 is clamped by the members 34 and 35, after which the gripping means is disposed in the downwardly facing channel 40. When this is accomplished, it can be seen that appropriate rotation of the threaded rod 42 by the head 43 will result in downward movement of the channel member 40, and thus the gripping members 34 and 35, with respect to the member 14, thereby causing vertical stretching of the face material 36. After the desired vertical stretching has been accomplished, a decorative, ornamental cover 47 is provided as shown in FIG. 7. The cover 47 is connected with the lower surface of the member 14 by a plurality of sheet metal screws (not shown).

SIGN FRAME

BACKGROUND AND SUMMARY OF THE INVENTION

This application is a continuation-in-part of our earlier application, Ser. No. 334,631, filed Feb. 22, 1973, and now abandoned.

The present invention relates generally to a sign frame and more specifically, to a sign frame and structure for mounting signs of the type which are adapted for internal illumination.

Traditionally, large signs such as billboards and the like were of the external illumination type where the sign or display was lighted by shining a source of light onto the face of the sign. Although attempts have been made to provide internally illuminated signs and displays approximating the size of billboards and the like, the results have been generally unsatisfactory primarily because of the problems involved in constructing a sign frame of the desired size and because of the problems involved in properly stretching the translucent surface or face of the sign which is disposed over the sign frame.

In contrast to the prior art, the present invention provides means for easily and quickly constructing a sign frame useable for an internally illuminated display and provides a novel and efficient means of stretching the face, and providing tension adjustment thereafter. Specifically, the sign frame of the present invention is made up of a plurality of modules which, when combined and connected together, provide a relatively rectangular sign frame having means for gripping the facing material at each of its edges with at least two of such means being adjustable to stretch and tension the facing material.

Accordingly, it is an object of the present invention to provide a sign frame incorporating a novel system for stretching the face of the sign or display and adjusting the tightness of the face. Specifically, this is accomplished by a pair of channels and gripping means which grip the facing material at each of its edges, at least two of which are adjustable to grip and stretch the facing material.

Another object of the present invention is to provide a sign frame of the type described which is modular in construction. Specifically, to construct such a sign frame, it is necessary to have at least a left hand module and a right hand module connected together. This would provide a sign of minimum length; however, if additional sign length is desired, additional modules, used singularly or in multiple, may be attached between the right hand and left hand end modules.

Still another object of the present invention is to provide a sign frame of modular construction wherein the source of illumination is adaptable for connection between modules.

Another object of the present invention is to provide a sign frame of modular construction in which the modules lend themselves readily to double faced displays.

A further object of the present invention is to provide a sign frame for an internally illuminated sign or display which is simple in construction yet rugged and low in cost and which is quick to assemble, change, service, store and transport.

These and other objects of the present invention will be readily evident with reference to the description of the preferred embodiment, the drawings and the appended claims.

DESCRIPTION OF THE DRAWINGS

FIG. 1 is a front elevational view of a left hand end module and part of an adjacent module connected thereto.

FIG. 1A is a diagramatic front elevational view of a constructed sign comprising a left hand module, a center module and a right hand module.

FIG. 2 is a sectional, elevational view as viewed along the line 2—2 of FIG. 1.

FIG. 2A is a sectional, elevational view as viewed along the line 2A—2A of FIG. 1.

FIG. 3 is a sectional, elevational view as viewed along the line 3—3 of FIG. 1.

FIG. 4 is an enlarged fragmentary pictorial view showing the upper face material gripping means before insertion into the upper edge of the frame.

FIG. 5 is a pictorial view, similar to that of FIG. 4, showing the relationship between the upper face gripping means and the frame.

FIG. 6 is an enlarged fragmentary pictorial view showing the lower face material gripping means and the manner in which the face material is stretched and tensioned vertically.

FIG. 7 is a pictorial view, similar to that of FIG. 6, showing the relationship between the lower gripping and adjusting means and the lower part of the frame.

DESCRIPTION OF THE PREFERRED EMBODIMENTS

With reference first to FIG. 1A, the sign frame of the present invention comprises a plurality of individual modules 10, 11 and 12. Specifically, as viewed in FIG. 1A, these modules include a left hand module 10, a center module 11 and a right hand module 12. As will be discussed below in more detail, the sign frame which is formed by connecting such modules together is adapted to support a facing material which is stretched over the surface of the sign frame for internal illumination.

Figure 8:
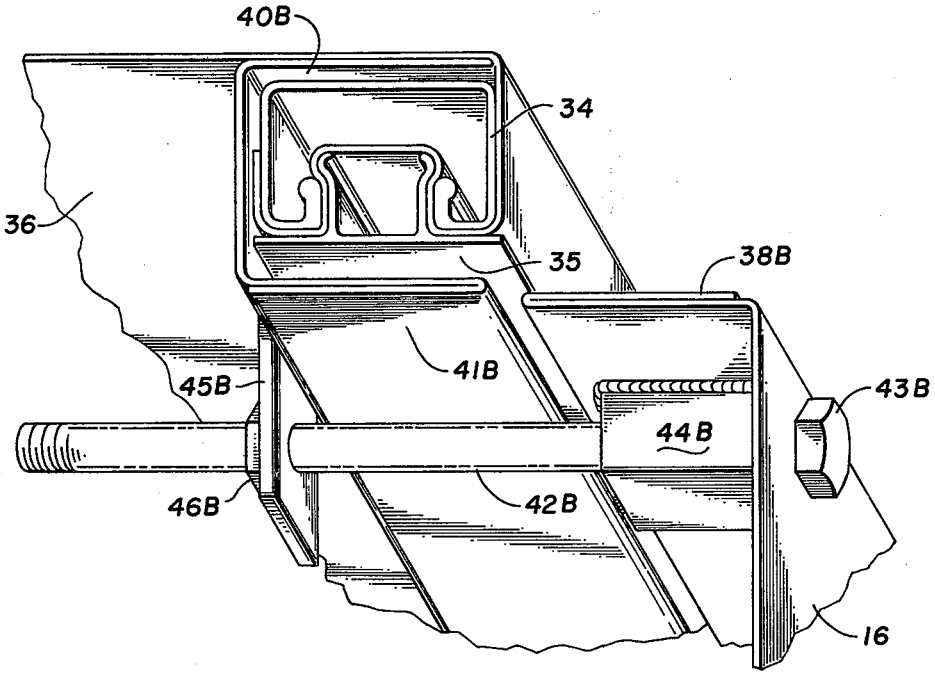
FIG. 8 is an enlarged fragmentary pictorial view showing the right hand face material gripping unit and the manner in which the face material is stretched and tensioned laterally.

With reference to FIG. 1, one of the individual modules, specifically the left hand module 10 is illustrated in detail. Also illustrated in FIG. 1 is a portion of an adjacent module connected with the module 10. Such adjacent module may be a center module such as the module 11 of FIG. 1A, if the sign frame is comprised of more than two modules, or it may be a right hand module such as the module 12 of FIG. 1A if the sign frame is comprised of only two modules. Each of the modules includes four bounding members: an upper member 13, a lower member 14, a left hand member 15 and a right hand member 16. It should be noted that in FIG. 1 which shows primarily a left hand module, the right Reference is next made to FIG. 8 which shows the means for gripping and securing the right hand edge of the translucent face material 36 and the manner in which the face material is laterally stretched. Specifically, the means for gripping the right hand edge of the face material is identical to the means for gripping the lower edge of the face material 36 which is illustrated in FIGS. 6 and 7. Specifically, the right hand bounding member 16 terminates in a facing 38B. Also, a U-shaped channel member 40B having a facing 41B is connected with the member 16 via the threaded rod 42B, the block 44B, the hex nut 46B and the bracket 45B. Also, identical to that illustrated in FIGS. 6 and 7, right hand edge of the face material 36 is gripped by the gripping elements 34 and 35 which are then disposed in the U-shaped member 40B. As is evident, when the rod 42B is appropriately rotated by the head 43B, the channel member 40B, and thus the gripping members 34 and 35, are moved toward the right as viewed in FIG. 8, thereby laterally stretching the face material 36.

Figure 9:
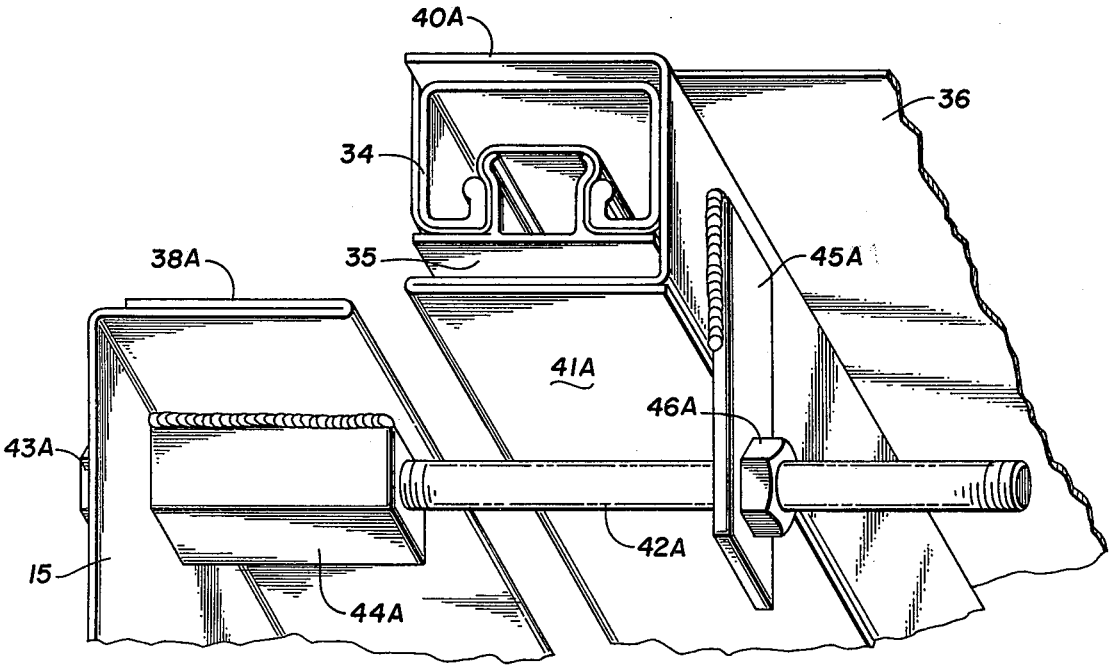
FIG. 9 is an enlarged fragmentary pictorial view showing the left hand face material gripping unit and the manner in which the face material is stretched and tensioned laterally.

FIG. 9 illustrates the manner in which the left hand edge of the face material 36 is gripped and the manner in which the face material 36 is laterally stretched. In principal, the means for laterally stretching the face material is identical to that which is illustrated in FIGS. 6 and 7 for vertically stretching such material and that illustrated in FIG. 8 for laterally stretching the face material from the right hand side. Specifically, the left hand bounding member 15 terminates in a facing 38A. Also, a U-shaped channel member 40A having a facing 41A is connected with the member 15 via the threaded rod 42A, the block 44A, the hex nut 46A and the bracket 45A. Also, identical to that illustrated in FIGS. 6 and 7, the left hand edge of the face material 36 is gripped by the gripping elements 34 and 35 which are then disposed in the U-shaped member 40A. As is evident, when the rod 42A is appropriately rotated by the head 43A, the channel member 40A, and thus the gripping members 34 and 35, are moved toward the left as viewed in FIG. 9, thereby laterally stretching the face material 36.

Figure 10:
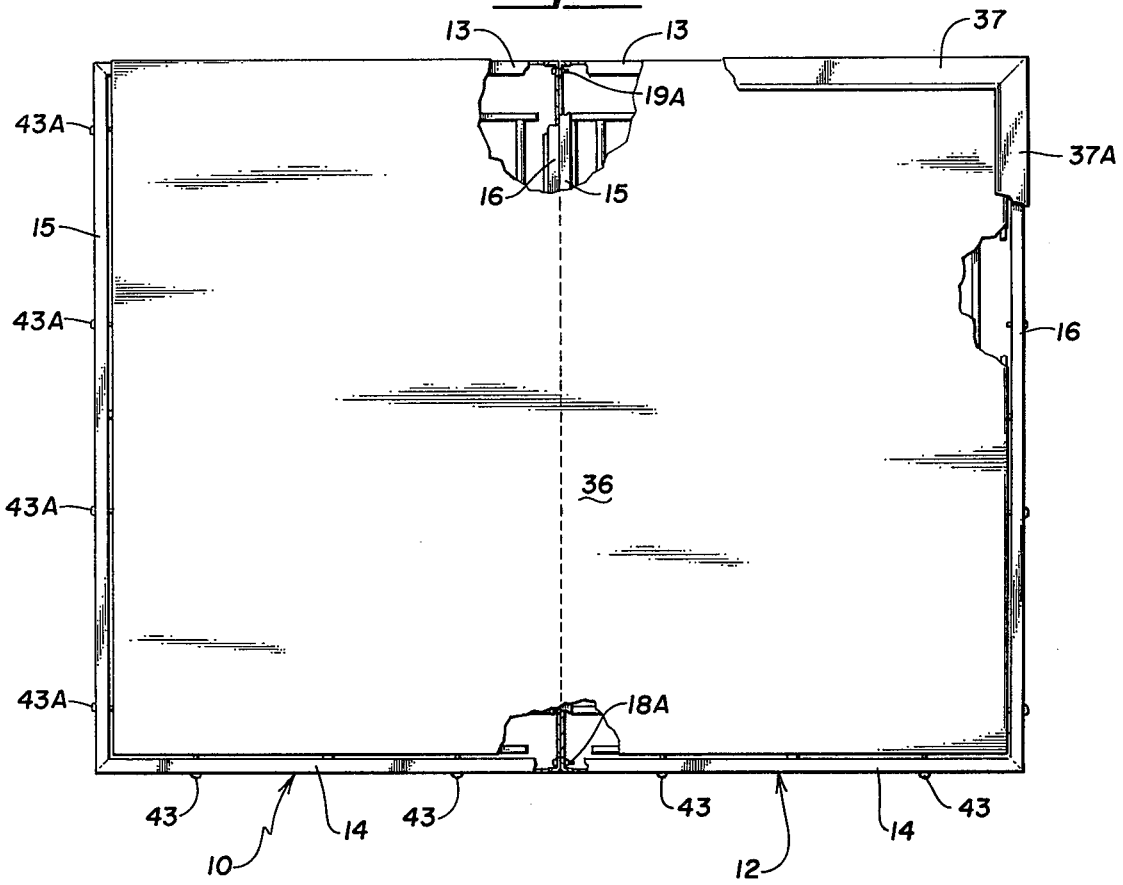
FIG. 10 is a front elevational view showing a constructed sign comprising a left hand and a right hand module.

Reference is next made to FIG. 10 which illustrates two adjacent modules connected together to form a sign frame and which also illustrates a portion of the face material 36 and the decorative covers 37 and 37A as they are intended to be connected to the frame. Specifically, the sign frame illustrated in FIG. 10 comprises a left hand module 10 and a right hand module 12. These modules 10 and 12 are connected together in the manner discussed above by a plurality of bolts 19A and 18A positioned at the top and bottom of each of the modules. As illustrated, the face material 36 is connected at its upper edge to the upper bounding member 13 in the manner illustrated specifically in FIGS. 4 and 5. The face material 36 is connected along its right and left hand edges to the right and left hand bounding members 16 and 15 respectively in the manner illustrated in FIGS. 8 and 9 respectively. Similarly, the face material 36 is gripped and connected along its lower edge to the bounding member 14 in the manner illustrated in FIGS. 6 and 7. After the face material 36 has been installed and sufficiently stretched, both laterally and vertically, the decorative covers 37 and 37A are installed around the entire periphery of the frame as illustrated.

The operation of the sign frame and specifically, the stretching means of the present invention may be best understood with general reference to the drawings. First, the sign frame is constructed and erected by connecting together a desired number of modules in the manner shown in FIG, 10. As previously discussed, the size of the desired sign frame will determine the number of modules used. After the modules have been erected, the face material 36, which in the preferred embodiment is a flexible plastic material such as polyvinyl chloride or the like, is layed out on a flat surface and the gripping members 34 and 35 are appropriately secured with each of the upper, lower, right hand and left hand edges of the face material 36 at the desired positions. Next, the entire face material 36, with the gripping members 34 and 35 attached to each of the edges is lifted to the sign frame and the gripping members at the top edge are placed in the channel member 31. Next, the gripping members at the right and left hand edges of the face 36 are placed in the channel members 40B (FIG. 8) and 40A (FIG. 9) respectively, and finally, the gripping members 34 and 35 at the lower edge are placed in the channel member 39 (FIGS. 6 and 7). When this is accomplished, the face material 36 is prepared for stretching.

The face material 36 is first stretched vertically about two-thirds of the total desired stretching by rotating the heads 43 as illustrated in FIG. 10. The heads 43 are rotated until the face 36 has been stretched to the extent desired. Next, the face material 36 is stretched laterally by rotating the heads 43A and 43B again until the face 36 has been stretched about two-thirds of the total intended to be stretched. Finally, the material 36 is stretched further both vertically and laterally to its final position. In this respect, it should be noted that preferably, the U-shaped channel member 40 should be adjacent to the face 38 of the member 14 as illustrated in FIG. 7 when the final stretching has been accomplished. Similarly, it is desirable that when the final stretching is accomplished laterally, the U-shaped members 40B (FIG. 8) and 40A (FIG. 9) will be adjacent to the faces 38B and 38A respectively. After the stretching is completed, the decorative covers or panels 37 and 37A (FIG. 10) are installed about the periphery of the frame.

It should be noted that in the preferred embodiment, adjustable facing material gripping means are provided along both the right hand and left hand edges of the sign frame in addition to the bottom edge. The reason for this is because of the greater lateral stretching due to the longer dimension. However, if the lateral dimension were relatively small, a single, laterally adjustable gripping means positioned along either the right or the left hand edge would suffice. Similarly, due to the dimensions of the sign frame, it may be desirable to have adjustable facing material gripping means disposed at each edge of the frame.

Figure 11:
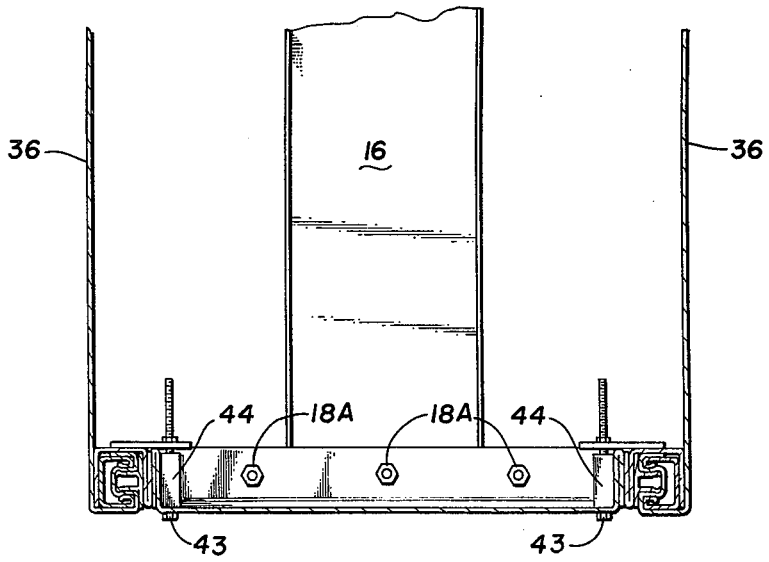
FIG. 11 is a sectional elevational view similar to FIG. 3 of a double faced sign or display.

With reference to FIG. 11, it is contemplated that the sign frame of the present invention would be suitable for double faced, internally illuminated signs or displays in which the fluorescent lights would provide illumination for both faces of the display. Such a double faced display would be constructed, erected and stretched similar to a single faced display except that the face gripping and stretching means would be present on both faces of the frame and the covering 19 (FIG. 1) which would normally exist on a single face display would be eliminated.

Specifically, FIG. 11 is similar to FIG. 3 of the single faced display, except that FIG. 11 is of a double faced display. As shown, both the front and back surfaces of such a frame would have gripping and stretching members along the lower edge to grip and stretch the face material 36 which would cover both faces of the frame. Similarly, such a double faced display would have both a front and rear top edge gripping means and appropriate front and rear lateral edge gripping and stretching means to grip and stretch the front and rear face material 36, 36.

Although the description of the preferred embodiment of the present invention has been quite specific, it is contemplated that various changes or modifications could be made to the structure without deviating from the spirit of the present invention. Therefore, it is intended that the scope of the present invention be dictated by the appended claims rather than by the description of the preferred embodiment.

We claim:

1. A relatively large scale sign comprising:

a sign frame having a plurality of edges and being comprised of a plurality of sign frame modules connected together to form said sign frame;

a single flexible facing material having a shape and dimensions approximately that of said sign frame extending over said plurality of frame modules and covering at least one face of said sign frame, said facing material being supported by said sign frame about its periphery and having an edge corresponding to each edge of said sign frame;

a facing material gripping means connected with each edge of said sign frame for gripping the corresponding edge of said facing material, the position of at least two of said gripping means being adjustable relative to said frame to tension said facing material; and means for adjusting the position of said adjustable gripping means relative to said sign frame for tensioning said facing material.

2. The sign of claim 1 wherein said sign is a double faced sign.

3. The sign of claim 1 being an internally illuminated sign.

4. The sign of claim 1 wherein at least one of said facing material gripping means is connected with said sign frame at a fixed position.

5. The sign of claim 4 wherein said sign is rectangular and wherein the facing material gripping means at the top edge of the sign frame is connected to said sign frame at a fixed position and wherein the facing material gripping means of each of the right hand, left hand and bottom edges is adjustable.

6. The sign of claim 1 wherein each of said facing material gripping means comprises corresponding elongated male and female clamping members for gripping said facing material therebetween.

7. The sign of claim 1 having means for connecting said gripping means to said sign frame comprising a generally U-shaped channel member connected with each of the edges of said sign frame with the open edge of said U-shaped member disposed outwardly with respect to the face of said sign frame.

8. The sign of claim 7 wherein the inner dimensions of said U-shaped member are sufficient to retain said gripping means therein.

9. The sign of claim 7 wherein the cross-sectional shape of said gripping means is generally rectangular and wherein the inner, lateral dimension of said U-shaped member is less than the diagonal dimension of the cross-section of said gripping means.

10. The sign of claim 1 wherein said gripping means includes separate gripping means at each edge of said facing material.

11. The sign of claim 1 wherein said adjusting means includes means for threadedly connecting said gripping means with its corresponding sign frame edges.

12. The sign of claim 11 wherein each of said adjustable facing material gripping means includes two threaded members spaced from each other.

13. The sign of claim 1 wherein said facing material is a plastic facing material such as polyvinyl chloride.

14. The sign claim 1 wherein each of said sign frame modules includes facing material gripping means.

* * * * *